US011692354B2

(12) United States Patent
Din

(10) Patent No.: US 11,692,354 B2
(45) Date of Patent: Jul. 4, 2023

(54) LIQUID DISPERSING PERFORATED PLATE

(71) Applicant: Michael Wong Din, Potomac, MD (US)

(72) Inventor: Michael Wong Din, Potomac, MD (US)

( * ) Notice: Subject to any disclaimer, the term of this patent is extended or adjusted under 35 U.S.C. 154(b) by 0 days.

(21) Appl. No.: 17/373,839

(22) Filed: Jul. 13, 2021

(65) Prior Publication Data

US 2023/0020774 A1 Jan. 19, 2023

(51) Int. Cl.
*E04D 13/064* (2006.01)
*F15D 1/00* (2006.01)

(52) U.S. Cl.
CPC ..... *E04D 13/064* (2013.01); *F15D 1/0005* (2013.01)

(58) Field of Classification Search
CPC ..... E04D 13/064; E04D 13/0641; E04D 13/0643; E04D 13/072; F15D 1/0005
USPC ..... 52/12
See application file for complete search history.

(56) References Cited

U.S. PATENT DOCUMENTS 3,248,827 A * 5/1966 Hardy ..... E04D 13/064 52/11
3,939,616 A * 2/1976 Schapker ..... E04D 13/064 52/97
4,254,594 A * 3/1981 Hammond et al. .. E04D 13/064 52/11
5,261,195 A 11/1993 Buckenmaier et al.
5,261,196 A 11/1993 Buckenmaier et al.
5,579,611 A 12/1996 Buckenmaier et al.
6,047,502 A * 4/2000 Kimmitt et al. ..... E04D 13/076 52/302.1
6,128,865 A 10/2000 Din
7,155,864 B1 1/2007 Din
7,721,489 B1 5/2010 Inzeo
8,434,269 B1 * 5/2013 Brochu ..... E04D 13/076 52/12
8,464,473 B2 6/2013 Din
8,539,722 B2 9/2013 Buckenmaier

FOREIGN PATENT DOCUMENTS

CA 2520788 A1* 11/2004
GB 2171124 A * 8/1986 ..... E04D 13/064
WO 9953157 A1* 10/1999 ..... E04D 13/064

* cited by examiner

*Primary Examiner* — Babajide A Demuren
(74) *Attorney, Agent, or Firm* — Edell, Shapiro & Finnan, LLC

(57) ABSTRACT

A liquid dispersing system includes a plate having a plurality of spaced holes passing through the plate. The plate has a thickness, a top portion, and a bottom portion, and each hole comprises a first opening at the top portion of the plate and a second opening at the bottom of the plate. The first opening and the second opening of each hole are differently-sized, so that the holes divide and disperse drops of the liquid into smaller droplets.

18 Claims, 10 Drawing Sheets

LIQUID DISPERSING PERFORATED PLATE

TECHNICAL FIELD

The present disclosure relates to discharge systems that disperse liquids, such as rainwater runoff from the roofs of structures.

BACKGROUND

Water discharge systems are typically installed on buildings to prevent water from flowing off roofs in an uncontrolled manner or from accumulating on the roof. For example, a gutter and downpipe may be installed on the eave of a structure to prevent water from damaging the walls. Water discharge systems can also direct water away to a suitable disposal site to avoid damage to the foundation of the structure.

DESCRIPTION OF EXAMPLE EMBODIMENTS

Overview

Figure 1:
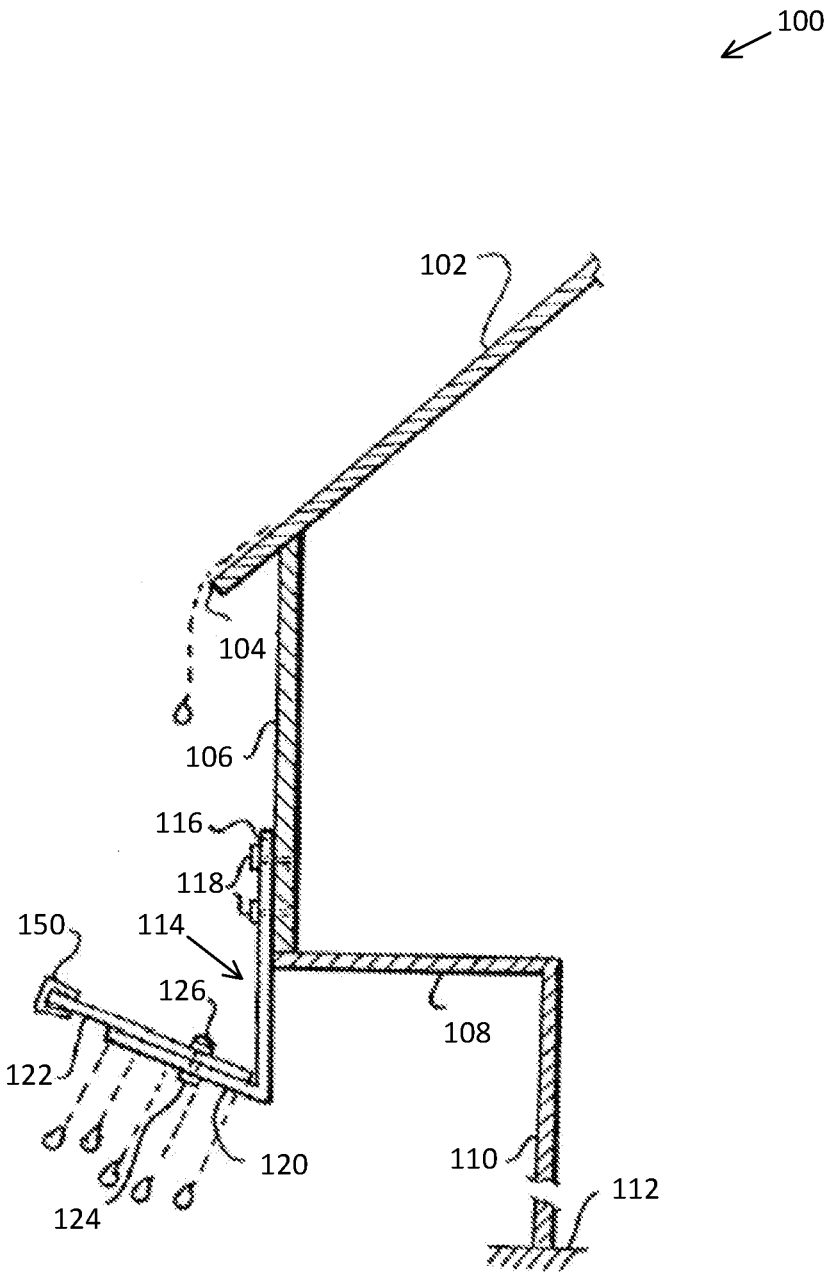
FIG. 1 is a side sectional view of a portion of a structure including a roof, fascia, and a mesh plate and corresponding support structure mounted to the fascia below the roof, in accordance with an example embodiment.

According to at least one embodiment, a liquid dispersing system includes a perforated plate having a plurality of spaced holes extending along and across the plate and passing through the plate. In these embodiments, the plate has a thickness, a top portion, and a bottom portion, and each hole comprises a first opening at the top portion of the plate and a second opening at the bottom of the plate, with the first opening and the second opening of each hole being differently-sized so that the holes divide and disperse drops of the liquid into smaller droplets.

In some of these embodiments, the liquid dispersing system is disposed along a wall of a structure. Additionally or alternatively, the liquid dispersing system may include a plurality of brackets mounted at spaced intervals along a wall below an upper end of a wall, wherein the brackets include vertical portions secured to the wall and lateral portions extending outwardly from the wall. In such embodiments, the plate may be secured to the outwardly extending bracket portions and extend outwardly from the wall in a path of liquid flowing downward from the upper end of the wall.

Example Embodiments

Embodiments are provided for discharge systems that disperse liquids, such as rainwater runoff from the roofs of structures.

Conventional water discharge systems often collect and guide water using gutters that are installed on the fascia of a building. However, gutter-based water discharge systems require regular maintenance in order to function properly, as debris such as leaves can accumulate, causing rainwater blockage and water pooling that eventually spills over the gutter. Additionally, conventional water discharge systems often utilize downspouts to guide the water away from a house. Downspouts can likewise become clogged, and can be susceptible to damage. Moreover, downspouts are often considered unsightly, and water discharge systems that utilize downspouts are more expensive due to the cost of materials, maintenance and installation.

In contrast, present embodiments provide an improved structure that disperses liquids from a building without using downspouts and in a manner that avoids single points of failure due to debris. In particular, present embodiments use a perforated plate that reduces the size of large drops of liquid into much smaller droplets that are readily dispersed away from a structure. In fact, the unique structure of the embodiments presented herein splits larger drops to form very small droplets which are prevented from agglomerating to cause ground erosion problems.

A relatively rigid thin plate is provided that is perforated with a mesh of fine openings that cause drops of water to be divided into much reduced sizes, thereby minimizing the accumulation of residual liquid. The openings can direct the flow of droplets in a desired direction away from the walls of the supporting structure, and the plate can be angled to further direct droplets in a particular direction.

Additionally, the holes in the plate can be substantially cone-shaped or frustum-shaped such that the cross-sectional area that a hole occupies at the top of the plate is different from the cross-sectional area occupied by the hole at the bottom of the plate. When fluid passes through a hole that has an increasingly larger cross-sectional area, the back pressure of the water decreases, thereby encouraging water to flow through the plate rather than pooling. In some embodiments, the holes may occupy a cross-sectional area at the top of the plate that is larger than the cross-sectional area of the bottom of the hole, thus narrowing as water passes through the hole. However, the limiting hole size remains the smaller hole size. The increased back pressure which reduces flow can be offset by a slightly larger drop distance from the edge of the roof to the perforated plate.

Thus, present embodiments can eliminate the use of gutters and leaders, minimize accumulation of leaves and debris, simplify or even eliminate drainage system cleaning, avoid water damage to adjacent walls, and reduce collection of ground water. The perforated mesh plate may also be used in other structures to reduce the size of liquid droplets, such as cooling towers or chemical processing facilities.

It should be noted that references throughout this specification to features, advantages, or similar language herein do not imply that all of the features and advantages that may be realized with the embodiments disclosed herein should be, or are in, any single embodiment. Rather, language referring to the features and advantages is understood to mean that a specific feature, advantage, or characteristic described in connection with an embodiment is included in at least one embodiment. Thus, discussion of the features, advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages will become more fully apparent from the following drawings, description and appended claims, or may be learned by the practice of embodiments as set forth hereinafter.

Embodiments are now described in detail with reference to the figures. FIG. 1 is a side sectional view of a portion 100 of a structure including a roof 102, fascia 106, and a plate 122 and corresponding support structure mounted to the fascia 106 below the roof 102, in accordance with an example embodiment.

As depicted, the slanted roof 102 has an edge 104 extending over a vertical fascia 106 below the edge 104. A horizontal overhang 108 is set back from the fascia to join the wall 110 (e.g., a side wall) of the house which is supported on a foundation built into the ground 112 (however, this is an example of only one structure on which embodiments presented herein may be installed). The support structure for plate 122 includes an L-shaped support angle bracket 114 which, in turn, includes a vertical portion 116 and a lateral portion 120. The vertical portion 116 is secured to the fascia by screws 118 passing through mounting holes 140, not shown in FIG. 1 but shown in further detail in FIGS. 9 and 10. Multiple mounting holes 140 may be provided in the vertical portion 116 of bracket 114 so that the drop distance of fluid from edge 104 to plate 122 can be adjusted.

The lateral portion 120 of bracket 114 extends outwardly at an angle below the fascia 106 and supports the relatively rigid thin plate 122 perforated by a plurality of minute holes, which are described in further detail below in connection with FIG. 3A-8. A bolt 126 passes through one of the mounting holes 141 of bracket 114 (shown in FIGS. 9 and 10) in lateral portion 120 and a hole 142 (shown in FIG. 2) in the plate 122. In the depicted embodiment, a nut 124 is coupled to bolt 126 to secure plate 122 to the support bracket 114. The second outermost hole 140 (shown in FIGS. 9 and 10) in the lateral bracket portion 120 permits the plate 122 to be secured in a position further removed from the fascia 106 in cases where the roof edge 104 extends further outwardly. The plate 122 can then be in an extended position in the path of liquid falling from the roof. However, holes 140 and 142, bolt 126 and nut 124 are merely examples and, in other embodiments, plate 122 may be secured to the support bracket 114 in any other desirable manner (e.g., via snap fit, detent locking, adhesive, etc.), either in addition to these elements or as an alternative to these elements.

In some embodiments, a series of support angle brackets 114 are mounted and spaced along the length of the fascia 106 of a structure, below the edges 104 of the roof 102 and extending outwardly to hold a plurality of aligned superimposed perforated plates 122 in the path of rainwater falling from the roof 102. Each plate 122 may be secured to one or more brackets 114 in any desirable fashion, and includes a mesh of fine openings or holes 128 (shown in FIG. 3A-8) which divides larger rain drops into much smaller droplets that are dispersed with a minimum of agglomeration and directed away from the adjacent wall 110 of the structure. The plate 122 is positioned at a given distance below, and extending outwardly from, the roof edge 104 so that the drops fall with sufficient momentum to pass through the holes 128 to be reduced into smaller droplets which are dispersed outwardly. The angle of the plate 122 and/or the holes 128 in the plate 122 determine the direction in which the droplets are dispersed.

The plate 122 and/or brackets 114 can be made of any suitable material or combination of materials. In some embodiments, the plate and/or brackets 114 may be a plastic or a metal, such as aluminum, galvanized steel, copper, and the like. The plate 122 and/or brackets 114, as well as the rest of the materials for the liquid dispersing system, may be painted for aesthetic purposes and/or treated to prevent damage from the elements. In some embodiments, strips 150 are provided that fit over the outer edges and may include colors to provide a decorative enhancement. The length of strips 150 may vary between two inches to fit over only the ends or may run up to five feet or more along the entire length of the outwardly extending edges of plates 122.

Figure 2:
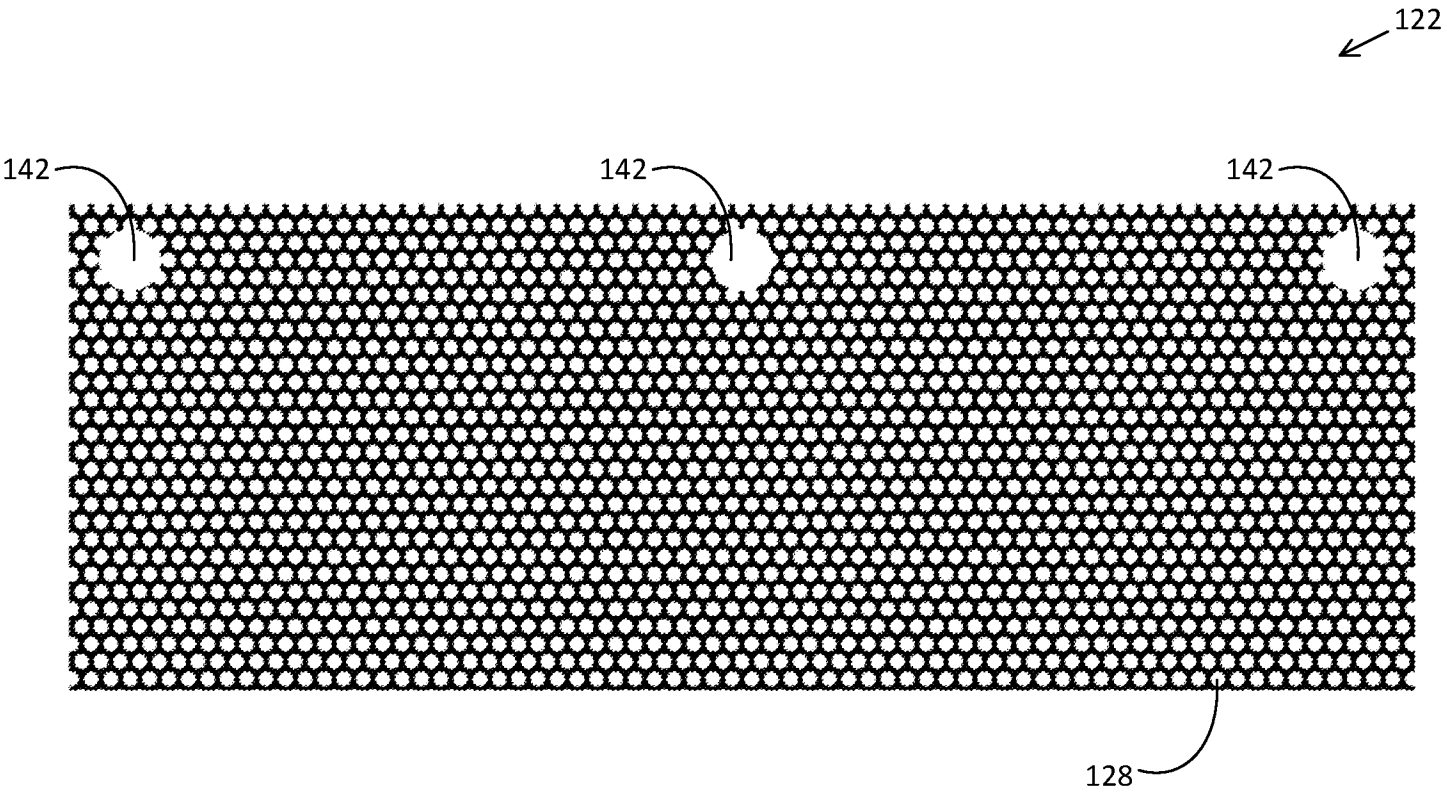
FIG. 2 is a plan view of a perforated mesh plate, in accordance with an example embodiment.

FIG. 2 is a plan view of a perforated mesh plate 122, in accordance with an example embodiment. As shown, plate 122 includes a plurality of smaller holes 128 that are disposed throughout the plate 122 to create a mesh through which fluid may flow, rather than collecting on top of the plate 122 as the fluid flows off of the roof 102. The holes 128 may be spaced regularly to create a pattern or uniform distribution of holes or irregularly to create a nonuniform distribution. In various embodiments, the number of holes, size of each hole, and/or spacing of each hole are selected to provide a maximum amount of holes without compromising the structural integrity of the plate 122 (e.g., making the plate 122 too flexible or prone to metal fatigue, etc.). Additionally, the number, size, and/or spacing of each hole may be selected based on a thickness of the plate 122, as a thicker plate may support a greater amount or size of holes, etc. Still further, although the depicted embodiment show circular holes, the holes could have any desirable cross-sectional shape, including hexagonal, square, triangular, etc. For example, the holes may extend through the plates and, thus, the height of the hole may be defined by the thickness of the plate. In fact, the holes presented herein may be effective at nearly zero length, so the minimum hole length will be defined by plate thickness, which must provide sufficient strength for the plate to resist fatigue, bending, wear, etc. experienced at a particular installation setting. Plate 122 may also include a number of larger holes 142 for mounting each plate 122, via brackets 114, to a fascia 106 of a building. In some embodiments, the holes 128 may be approximately one-sixteenth of an inch in diameter, and the holes 142 may be approximately one-fourth of an inch in diameter.

Figure 3A:
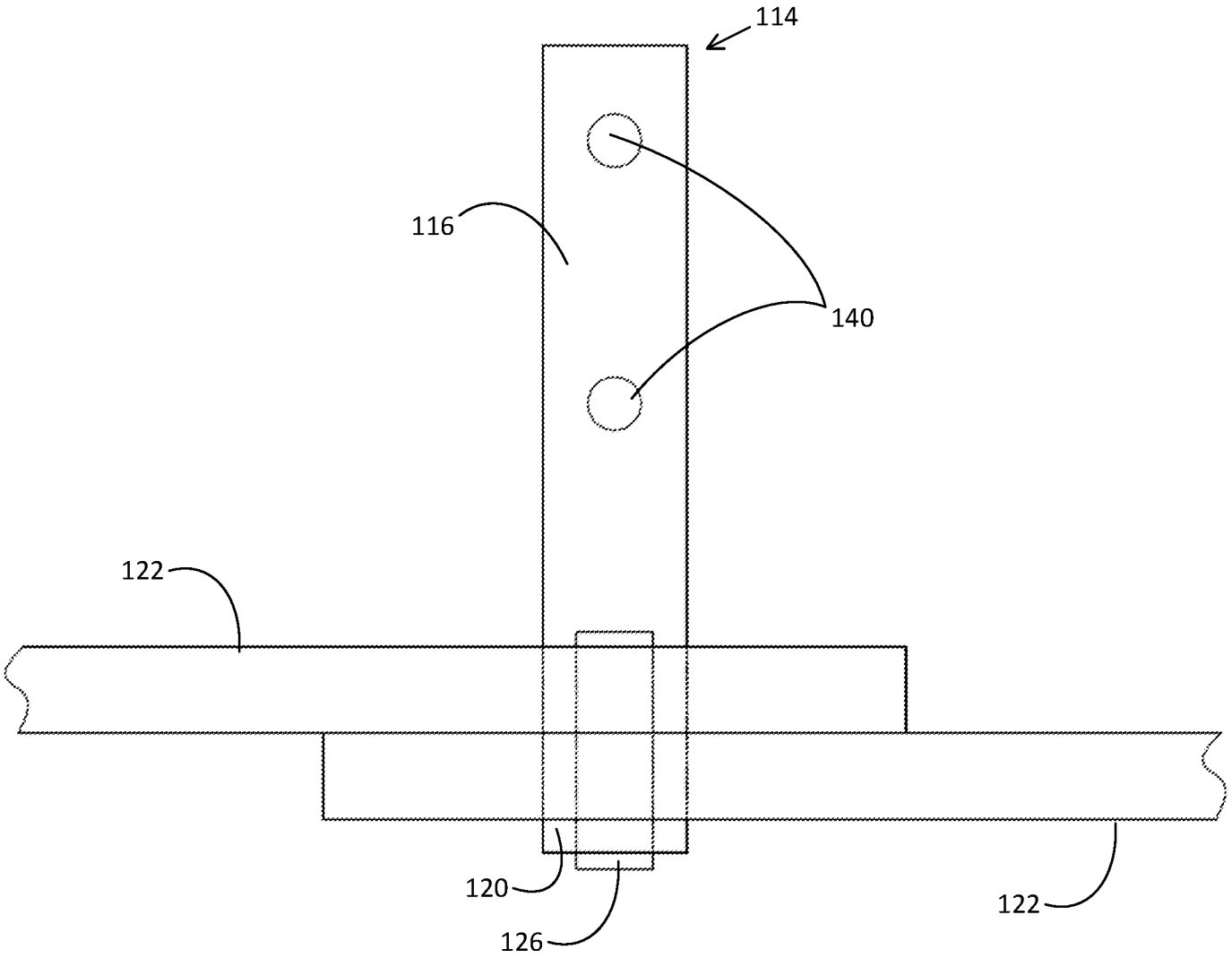
FIG. 3A is an elevation view of a portion of two superimposed ends of mesh plates supported by an angled support bracket, in accordance with an example embodiment.

FIG. 3A is an elevation view of a portion of two superimposed ends of mesh plates 122 supported by an angled support bracket 114, in accordance with an example embodiment. The adjacent plates 122 are held in place by a common shared bolt 126 that passes through each plate 122 and the bracket 114. The ends of plates 122 are also stacked over each other and rest on lateral portion 120 of bracket 114. However, again, these attachment elements are only shown as an example and the plates 122 could be attached to brackets 114 in any desirable manner. That said, providing brackets at the edges of plates 122 and at the center of each plate 122 may minimize deformation of plates 122. Bracket Mounting holes 140 are disposed in vertical portion 116 of bracket 114. The superimposed ends of the plates 122 can be held in a straight line by open wedged-shaped alignment clips or strips 150 which overlap the ends to maintain the plates 122 in the desired horizontal position along the wall 110.

Figure 3B:
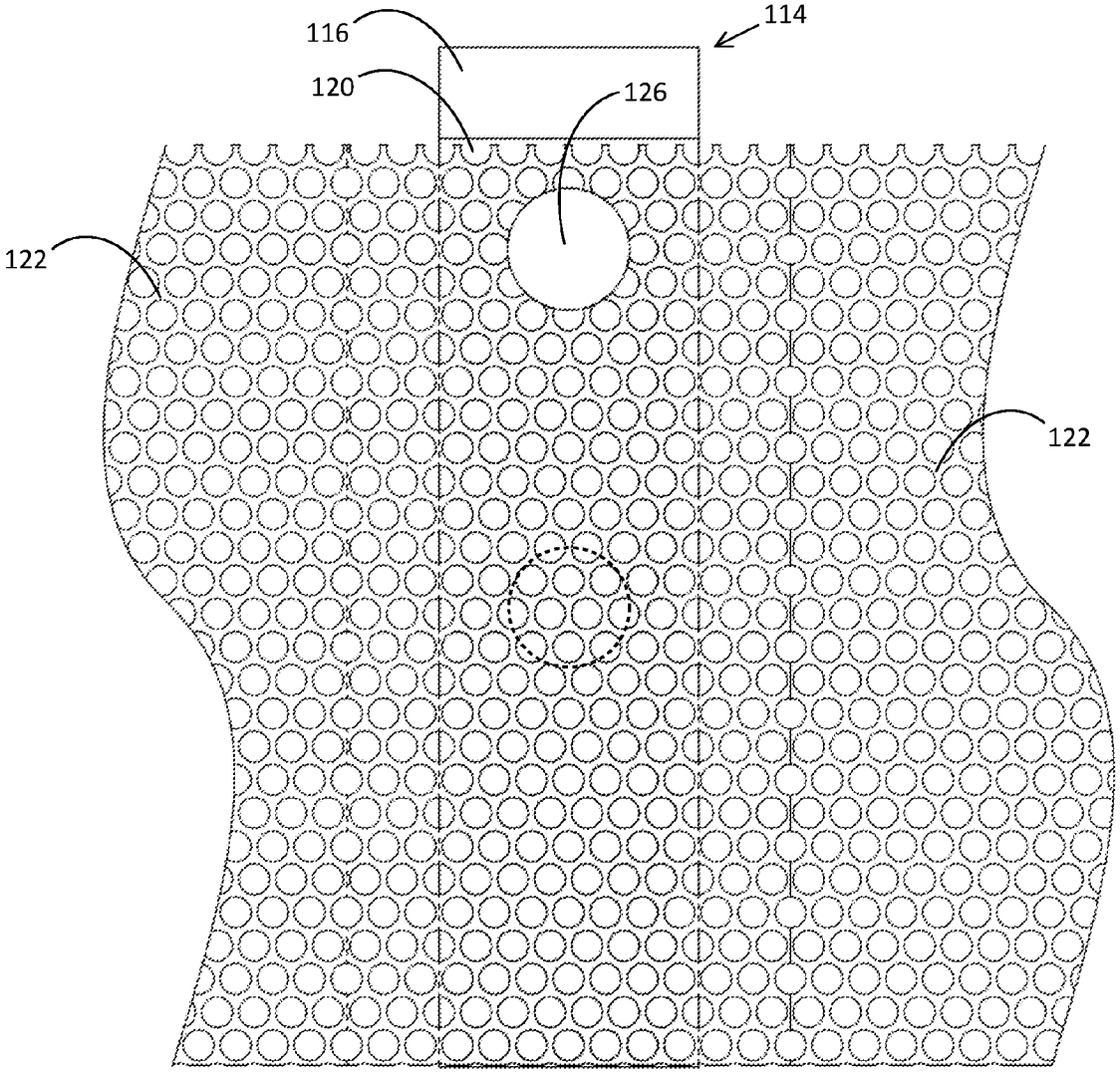
FIG. 3B is a plan view of a portion of two superimposed ends of mesh plates supported by an angled support bracket, in accordance with an example embodiment.

FIG. 3B is a plan view of a portion of two superimposed ends of mesh plates 122 supported by an angled support bracket 114, in accordance with an example embodiment. For example, the plan view of FIG. 3B may correspond to the same embodiment depicted in the elevation view of FIG. 3A. As shown in FIG. 3B, plates 122 are superimposed, with one on top of the other. The plates 122 rest on the lateral portion 120 of bracket 114, and are held in place by bolt 126, which passes through both plates 122 and bracket 114. The plates 114 may be aligned such that holes 142 at the end of each plate 122 are aligned and also align with a mounting hole 141 in the lateral portion 120 of bracket 114.

Figure 4A:
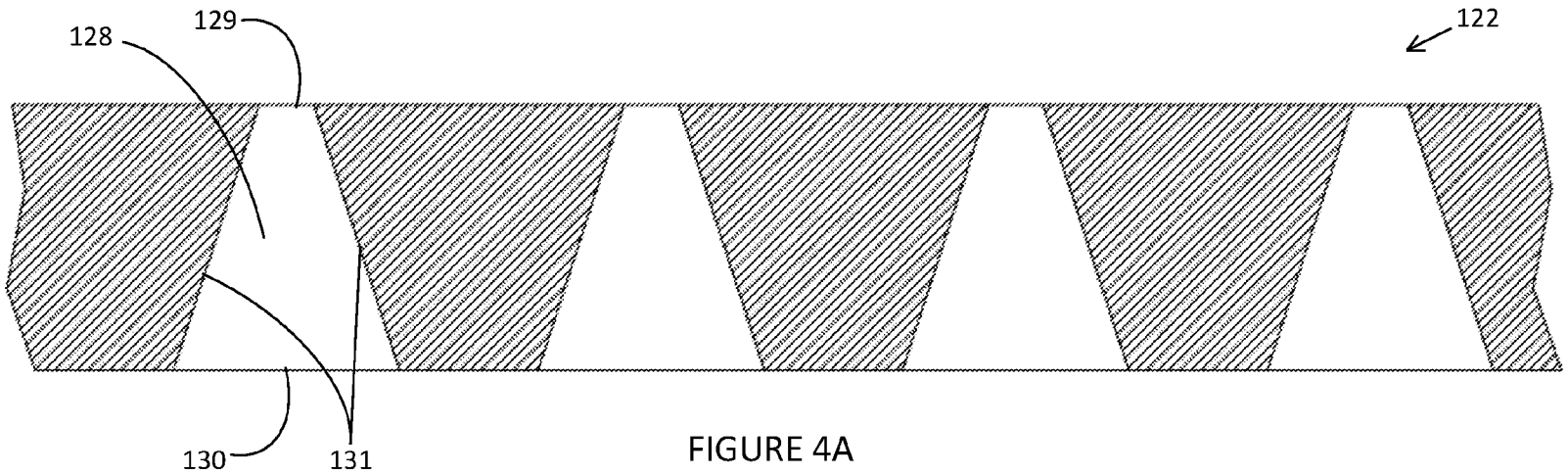
FIG. 4A is a side sectional view of a portion of a perforated plate with holes that expand in a direction of flow of a liquid, in accordance with an example embodiment.

FIG. 4A is a side sectional view of a perforated plate 122 with holes 128 that expand in a direction of flow of a liquid, in accordance with an example embodiment. The volume of each hole 128 is defined according to the absence or removal of material from the plate 122. Thus, each hole 128 can be defined according to the size and shape of the top opening 129, the bottom opening 130, and the side 131. In some embodiments, the hole 128 may occupy a volume that is substantially conical-shaped or frustum-shaped. In the depicted example, the side 131 of the hole 128 is substantially smooth, providing a consistent and gradual transition from the top opening 129 to the bottom opening 130.

Figure 4B:
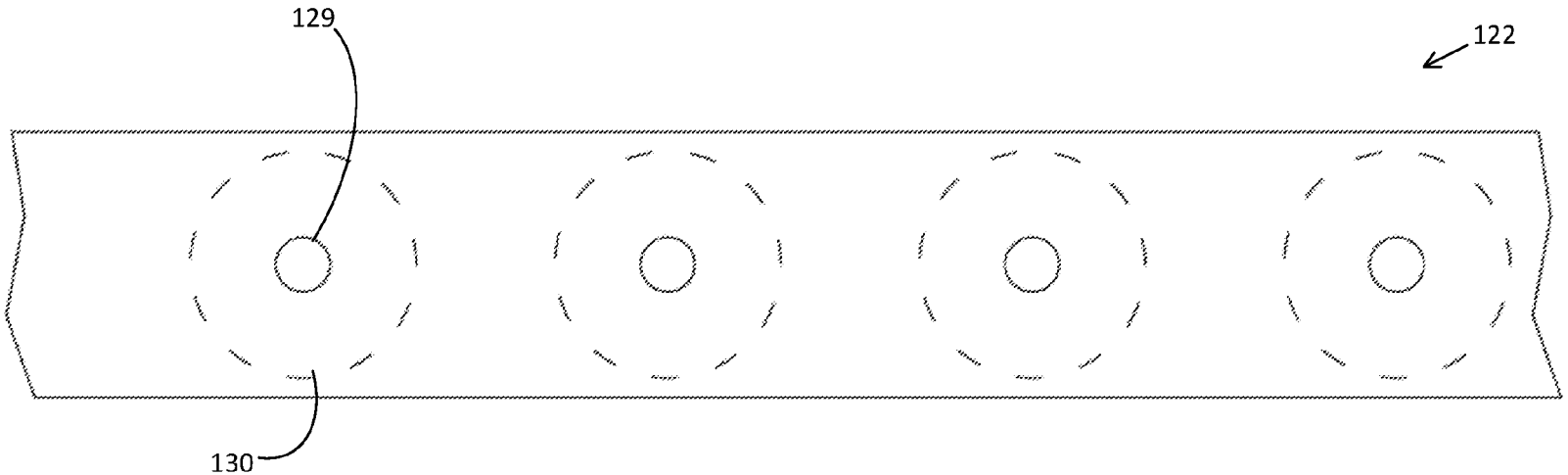
FIG. 4B is a plan view of a portion of a perforated plate with holes that expand in a direction of flow of a liquid, in accordance with an example embodiment.

FIG. 4B is a plan view of a perforated plate 122 with holes 128 that expand in a direction of flow of a liquid, in accordance with an example embodiment. For example, the plan view of FIG. 4B may correspond to the same embodiment depicted in the side sectional view of FIG. 4A. As depicted, a top opening 129 and bottom opening 130 are each substantially circular-shaped. However, in various embodiments, the top opening 129 and/or bottom opening 130 may be any desired shape, including irregular shapes, which may result from a machining process for creating the holes. As long as the top opening 129 occupies a smaller cross-sectional area in the plate 122 than the bottom opening 130, the pressure of a fluid will drop as it enters through the hole 128 (via top opening 129) and disperses into smaller drops. At the same time, the expanding size of the hole may ensure that the hole does not provide an unnecessary amount of constriction (minimizing pressure drop across the hole) that unwantedly slows the flow-through rate of the hole. That is, the larger bottom opening 130 reduces or eliminated backpressure and capillary forces that might resist liquid movement through the hole. Overall, this allows more liquid to flow through the holes than would flow through a straight hole.

Figure 5:
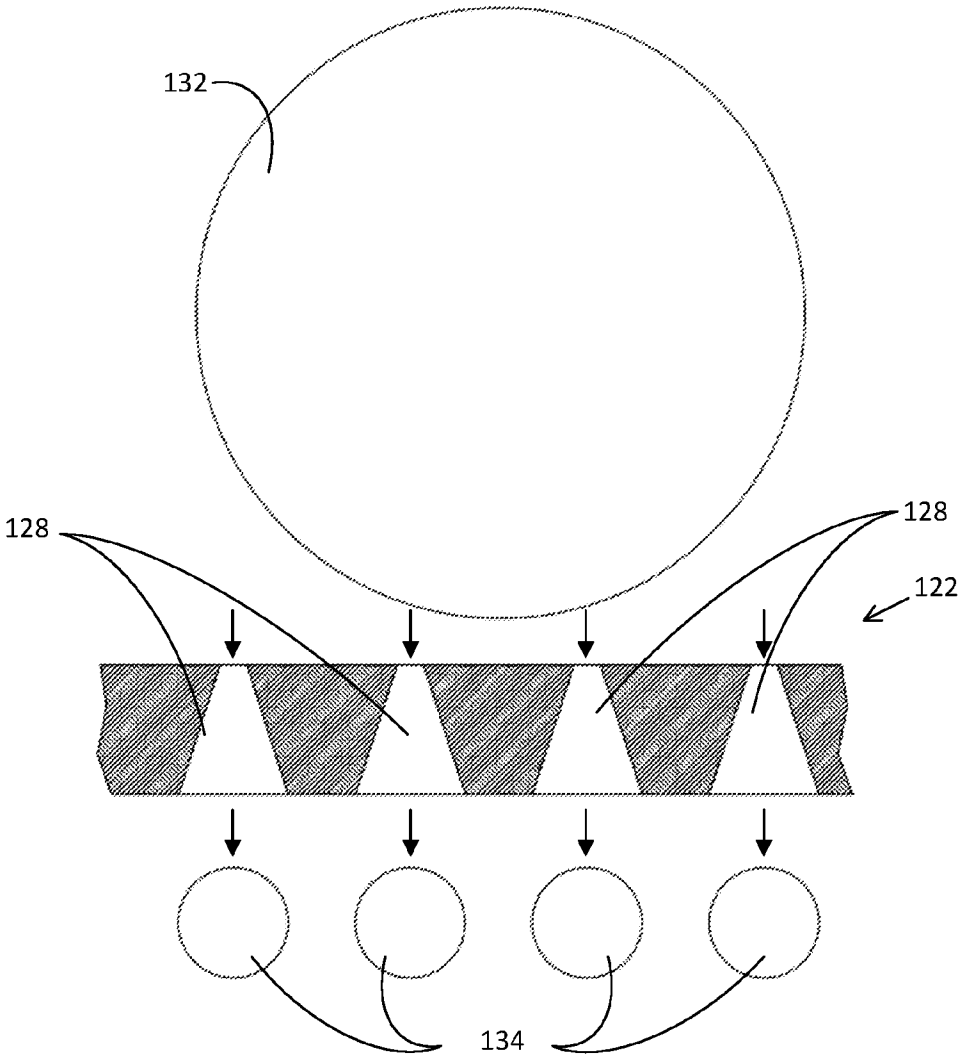
FIG. 5 is a side sectional view of a portion of a perforated plate with liquid passing through the holes, in accordance with an example embodiment.

FIG. 5 is a side sectional view of a portion of a perforated plate 122 with liquid droplets passing through the holes, in accordance with an example embodiment. For example, FIG. 5 may correspond to the same embodiment depicted in FIG. 4A and/or FIG. 4B. As depicted, a larger drop 132 impacts the top of the plate 122 passing through the holes 128 in the direction indicated by the arrows, and emerging as smaller droplets 134, insofar as when the terms "larger," "large," or the like are used to describe drops, these terms indicate that a drop has a dimension (e.g., a diameter or size) that is larger than a corresponding dimension of a hole (e.g., a diameter of a top or bottom opening of a hole). Likewise, the reverse holds true if drops are described as "small," "smaller" or the like as compared to holes and/or if holes are described as "small," "smaller" or the like as compared to drops. That all said, smaller droplets 134 may continue falling in a desired direction to disperse liquid away from a structure.

Figure 6A:
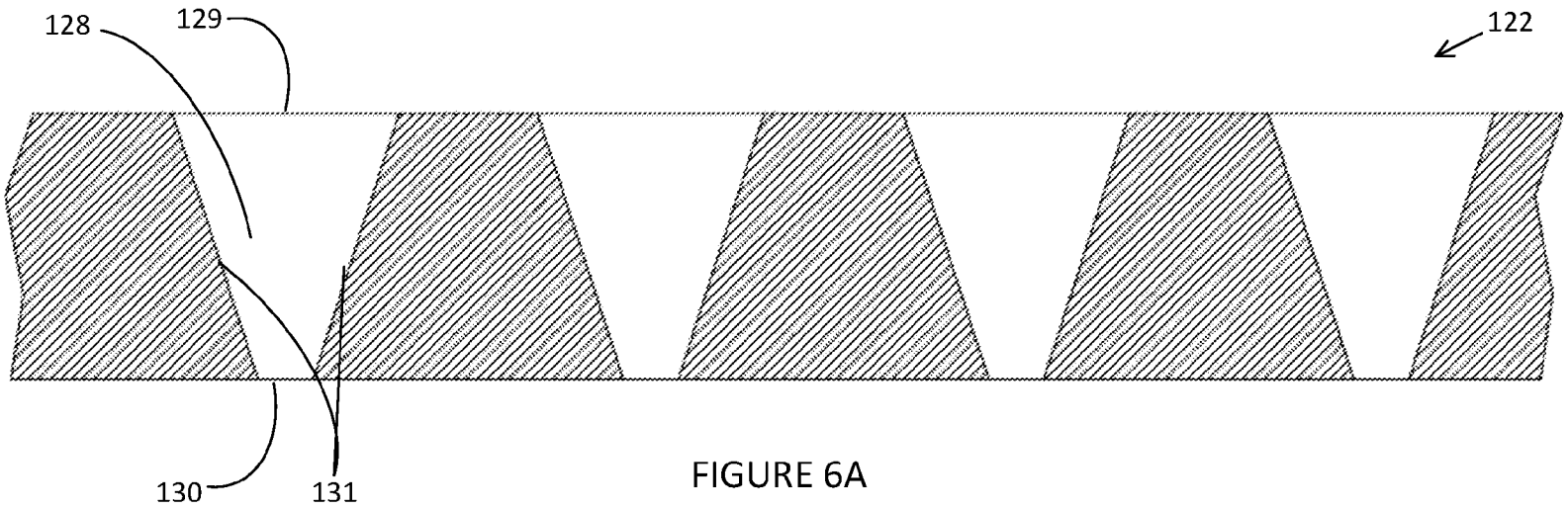
FIG. 6A is a side sectional view of a portion of a perforated plate with holes that narrow in a direction of flow of a liquid, in accordance with an example embodiment.

Referring to FIG. 6A, this Figure is a side sectional view of a perforated plate 122 with holes that narrow in a direction of flow of a liquid, in accordance with an example embodiment. Like in FIG. 4A, the volume of each hole 128 is defined according to the absence or removal of material from the plate 122. Thus, again, each hole 128 can be defined according to the size and shape of the top opening 129, the bottom opening 130, and the side 131. In some embodiments, the hole 128 may occupy a volume that is substantially conical-shaped or frustum-shaped. In the depicted example, the side 131 of the hole 128 is substantially smooth, providing a consistent and gradual transition from the top opening 129 to the bottom opening 130. However, in contrast with the embodiment of FIG. 4A, the top opening 129 is now smaller than the bottom opening 130.

Figure 6B:
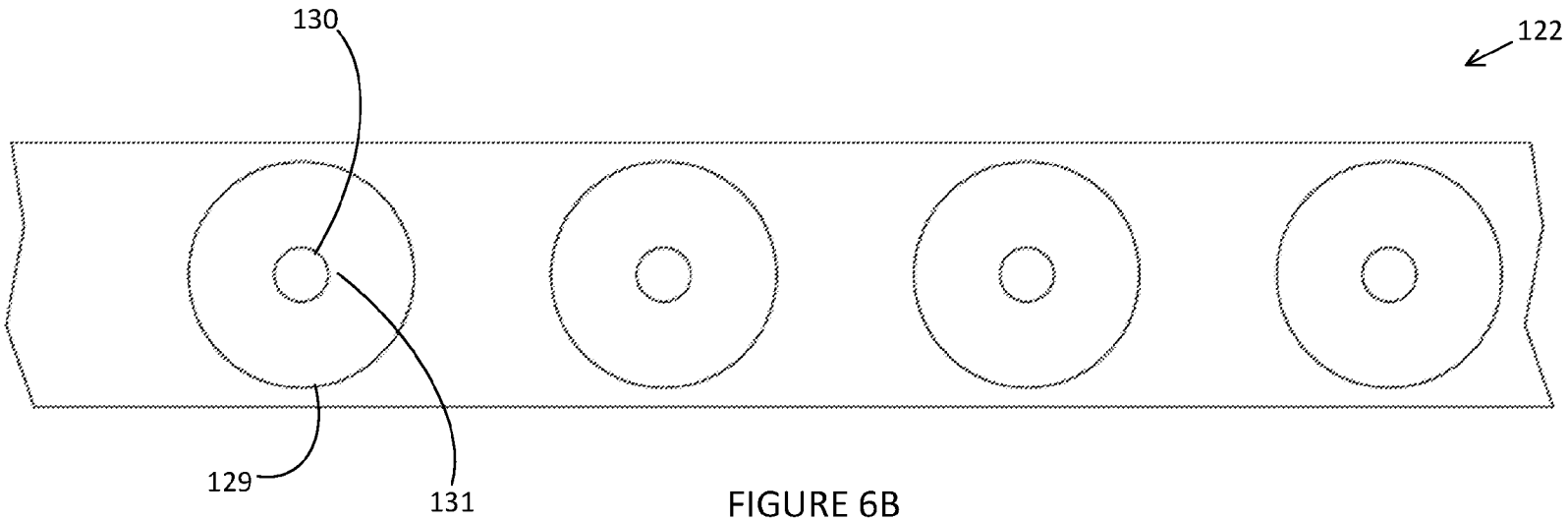
FIG. 6B is a plan view of a portion of a perforated plate with holes that narrow in a direction of flow of a liquid, in accordance with an example embodiment.

FIG. 6B is a plan view of a perforated plate 122 with holes 128 that narrow in a direction of flow of a liquid, in accordance with an example embodiment. For example, the plan view of FIG. 6B may correspond to the same embodiment depicted in the sectional view of FIG. 6A. As depicted, a top opening 129 and bottom opening 130 are each substantially circular-shaped. However, in various embodiments, the top opening 129 and/or bottom opening 130 may be any desired shape, including irregular shapes, which may result from a machining process for creating the holes. As long as the top opening 129 occupies a greater cross-sectional area in the plate 122 than the bottom opening 130, the capture of liquid volume will be enhanced, thereby preventing liquid from bypassing the holes (e.g., by escaping off the edge of the plate). The captured liquid will then become constricted by the narrowing hole, which will raise the pressure drop of the fluid as it moves through the hole. Back pressure in the hole decreases the flow rate as the hole fills, reducing the capacity of the hole. To offset the reduction effect, the fall distance of the liquid from the roof edge 104 to the lateral portion 120 of the bracket may be increased to achieve a same flow capacity.

Figure 7:
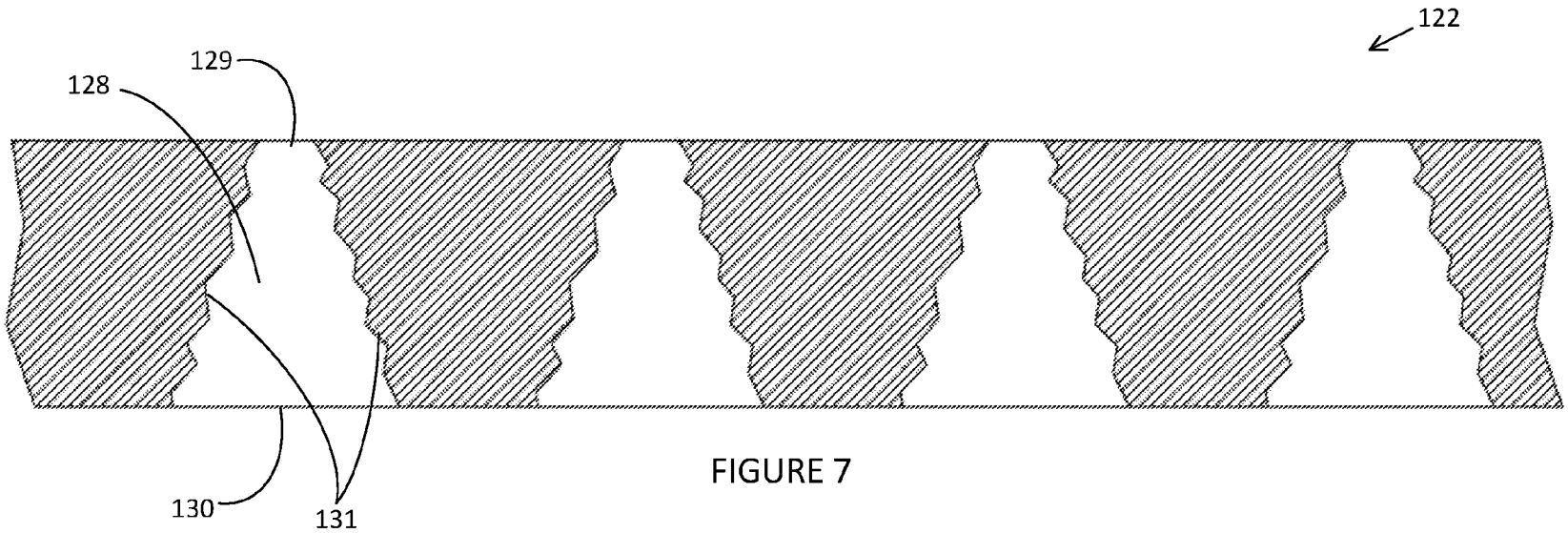
FIG. 7 is a side sectional view of a portion of a perforated plate with holes that expand in a direction of flow of a liquid and have irregular sides, in accordance with an example embodiment.

FIG. 7 is a side sectional view of a perforated plate 122 with holes 128 that expand in the direction of liquid flow and have irregular sides, in accordance with an example embodiment. As depicted, the top opening 129 occupies less cross-sectional area of the plate 122 than the bottom opening 130. The sides 131 are irregular, and may be rough or jagged as a result of creating the hole 128 (e.g., using a puncturing process). This sidewall configuration may achieve similar flow and pressure advantages to the embodiments shown in FIGS. 4A, 4B, and 5, but may also discourage liquid from adhering to the sides, causing liquid to disperse along the sides and exit the hole 128 at different radial portions of the hole 128.

Figure 8:
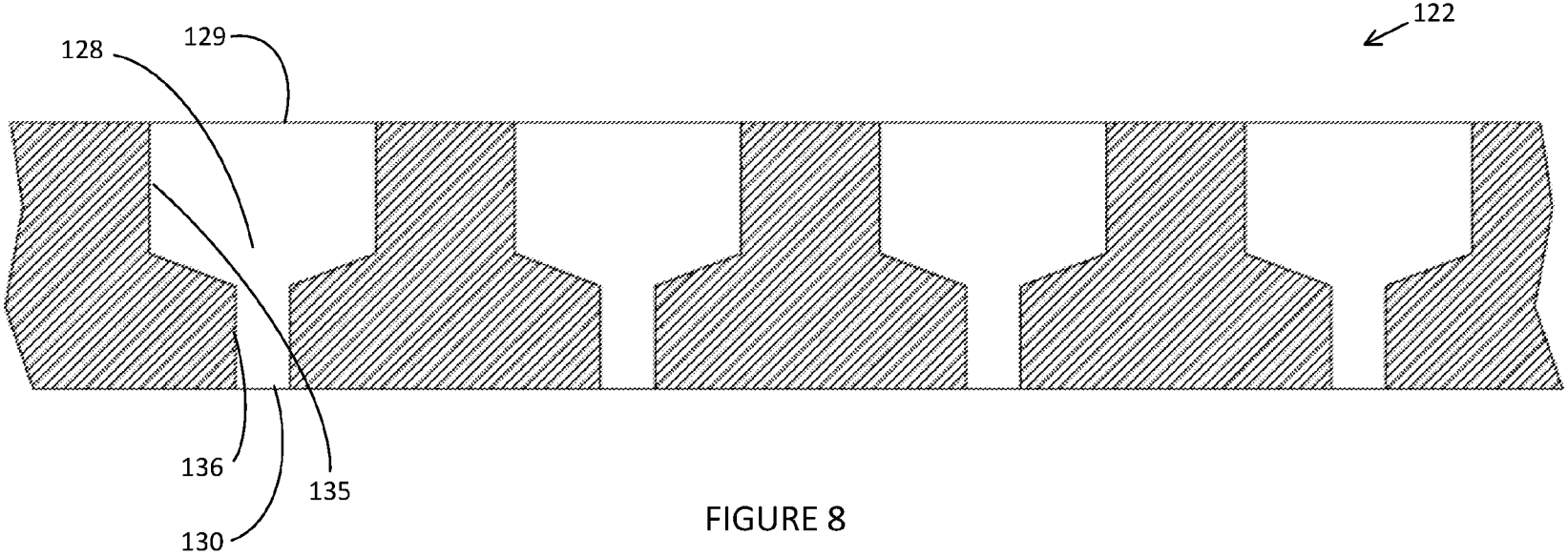
FIG. 8 is a side sectional view of a portion of a perforated plate with holes that narrow from a first wider portion to a second narrower portion in a direction of flow of a liquid, in accordance with an example embodiment.

FIG. 8 is a side sectional view of a perforated plate 122 with holes 128 that narrow from a first wider portion 135 to a second narrower portion 136 in the direction of liquid flow, in accordance with an example embodiment. As shown, a hole 128 may substantially match the cross-sectional area of the top opening 129 for a first portion 135 of the hole before narrowing to a second portion 136 with a cross-sectional area that substantially matches the bottom opening 130. This sidewall configuration may achieve similar flow and pressure advantages to the embodiments shown in FIGS. 6A and 6B. The bottom opening 130 may also guide fluid along a consistent path over time since wear of the bottom opening 130 will not erode the shape of the bottom opening 130 in the embodiment of FIG. 8.

Notably, overall, regardless of the specific shape of the holes, the embodiments of FIGS. 4A-8 all include a restricted dimension adjacent to a widening section. That is, the most restrictive part or portion of a hole is adjacent an increasingly open portion of a hole. This improves the operation of the liquid dispersion plate by allowing more liquid to pass through the liquid distribution plate (as compared to a plate with straight holes) because the increasingly open portion reduces pressure drop along the thickness of the plate. Increasing the amount of liquid that flows through the holes decreases the amount of liquid that flows off the plates in an uncontrolled manner (e.g., off an edge), which prevent trenching, erosion, and other detrimental effects at the ground level (among other advantages). This may also provide advantages in liquid and/or chemical treatment/handling settings, where maximum control and/or fast flow rates are often desirable.

Figure 9:
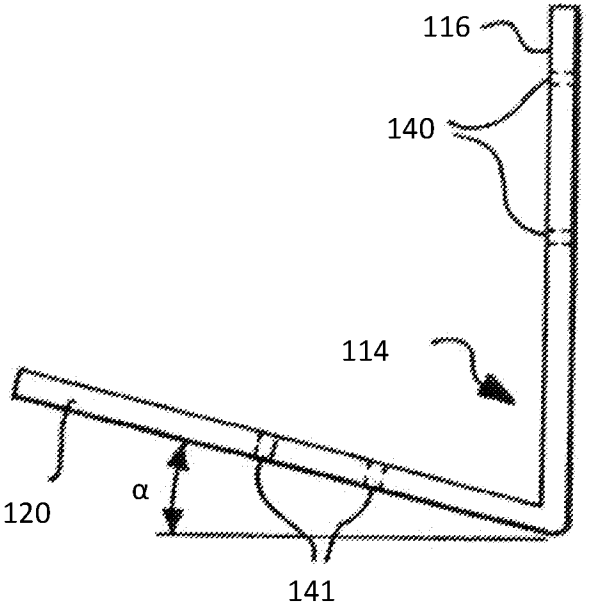
FIG. 9 is a side sectional view of a support bracket, in accordance with an example embodiment.

Referring to FIG. 9, this Figure is a side sectional view of a support bracket 114, in accordance with an example embodiment. As shown, the support bracket 114 includes an angled lateral portion 120 for supporting a perforated plate 122, mounting holes 141 for attaching a perforated plate 122 to the lateral portion 120, and mounting holes 140 for attaching the support bracket 114 to a fascia 106 of a structure via a vertical portion 116. The angle, α, of the angled lateral portion 120 may be any desired angle. In some embodiments, the angle is approximately between 15° and 30° to facilitate dispersal of liquids away from the wall 110 of a structure. In various embodiments, there may be additional or fewer vertical mounting holes 140 and/or plate mounting holes 141, including a minimum of one vertical mounting hole 140 and/or plate mounting hole 141, or three or more vertical mounting holes 140 and/or plate mounting holes 141.

Figure 10:
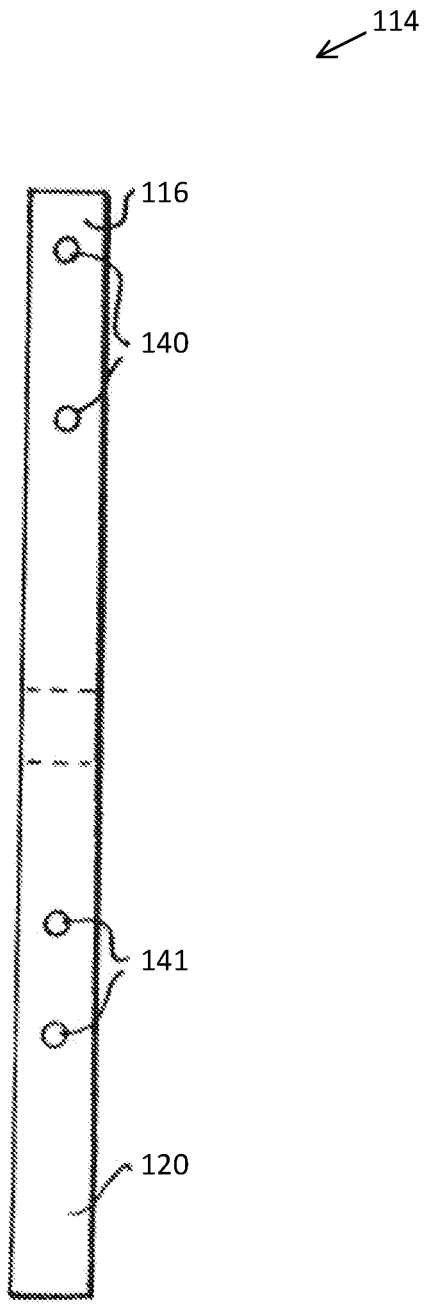
FIG. 10 is a front view of a support bracket in an unformed shape before bending to an angle as in FIG. 9, in accordance with an example embodiment.

FIG. 10 is a front view of a support bracket 114 in an unformed shape before bending to an angle as in FIG. 9, in accordance with an example embodiment. As depicted, FIG. 10 shows the support bracket 114 as a narrow, long thin straight plate in an unformed shape prior to having the lower portion 120 being bent to the angle as shown in FIG. 9. This angle may be between approximately 15° and 30° from the horizontal to hold the plate 122 at that angle, or may be held at a horizontal angle or other angles depending upon the desired position of the mesh plate and the angle of holes 128 in the plate 122. The bracket 114 may be made of a semi-flexible metal, such as steel, that can be bent without substantially causing damage to the bracket 114.

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein. As a specific example, the embodiments presented herein are either narrowing or widening, but other embodiments may combine these profiles in any desirable manner (e.g., narrowing and then widening or vice versa or one overall pattern sandwiched between two patterns of the other).

Note that in this Specification, references to various features (e.g., elements, structures, nodes, modules, components, engines, logic, steps, operations, functions, characteristics, etc.) included in 'one embodiment', 'example embodiment', 'an embodiment', 'another embodiment', 'certain embodiments', 'some embodiments', 'various embodiments', 'other embodiments', 'alternative embodiment', and the like are intended to mean that any such features are included in one or more embodiments of the present disclosure, but may or may not necessarily be combined in the same embodiments.

As used herein, unless expressly stated to the contrary, use of the phrase 'at least one of', 'one or more of', 'and/or', variations thereof, or the like are open-ended expressions that are both conjunctive and disjunctive in operation for any and all possible combination of the associated listed items. For example, each of the expressions 'at least one of X, Y and Z', 'at least one of X, Y or Z', 'one or more of X, Y and Z', 'one or more of X, Y or Z' and 'X, Y and/or Z' can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Finally, unless expressly stated to the contrary, the terms 'first', 'second', 'third', etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, 'first X' and 'second X' are intended to designate two 'X' elements that are not necessarily limited by any order, rank, importance, temporal sequence, or hierarchy of the two elements. Further as referred to herein, 'at least one of' and 'one or more of' can be represented using the '(s)' nomenclature (e.g., one or more element(s)).

What is claimed is:

1. A liquid dispersing system disposed along a wall of a structure, comprising:

a plurality of brackets mounted at spaced intervals along the wall below an upper end of the wall, wherein the plurality of brackets include vertical portions secured to the wall and lateral portions extending outwardly from the wall; and a plate having a plurality of spaced holes extending along and across the plate and passing through the plate, wherein the plurality of spaced holes comprise a mesh of holes that divide and disperse drops of liquid flowing downward from the upper end of the wall into smaller droplets, wherein the plate has a thickness, a top portion, and a bottom portion, wherein each hole comprises a first opening at the top portion of the plate and a second opening at the bottom portion of the plate, wherein the first opening and the second opening of each hole are differently-sized, and wherein a height of each hole corresponds to a thickness of the plate, wherein the plate is secured to the lateral portions of the plurality of brackets and extends outwardly from the wall in a path of the liquid flowing downward from the upper end of the wall.

2. The liquid dispersing system of claim 1, wherein the first opening of each hole is larger than the second opening.

3. The liquid dispersing system of claim 1, wherein the first opening of each hole is smaller than the second opening.

4. The liquid dispersing system of claim 3, wherein each hole is defined according to a hole side that extends between the first opening and the second opening, and wherein the hole side provides a transition from the first opening to the second opening such that a first portion of each hole includes a cross sectional area that is substantially similar to a cross sectional area of the first opening, and a second portion of each hole includes a cross sectional area that is substantially similar to a cross sectional area of the second opening.

5. The liquid dispersing system of claim 1, wherein each hole is defined according to a hole side that extends between the first opening and the second opening, and wherein the hole side provides a substantially smooth transition from the first opening to the second opening.

6. The liquid dispersing system of claim 1, wherein each hole is defined according to a hole side that extends between the first opening and the second opening, and wherein the hole side provides an irregular transition from the first opening to the second opening.

7. The liquid dispersing system of claim 1, wherein each hole is substantially frustum-shaped.

8. The liquid dispersing system of claim 1, wherein the plate and brackets extend outwardly from the wall at an angle and the plurality of spaced holes pass through the plate at an angle with respect to the plate, and wherein the angle of the plate and the angle of the plurality of spaced holes therethrough determine a direction in which the droplets are dispersed.

9. A plate for dispersing liquid comprising:

a plate having a plurality of spaced holes extending along and across the plate and passing through the plate, wherein the plate has a thickness, a top portion, and a bottom portion, wherein the plurality of spaced holes comprise a mesh of holes that divide and disperse drops of liquid flowing downward toward the top portion of the plate into smaller droplets, wherein each hole comprises a first opening at the top portion of the plate and a second opening at the bottom portion of the plate, wherein the first opening and the second opening of each hole are differently-sized, and wherein a height of each hole corresponds to a thickness of the plate.

10. The plate of claim 9, wherein the first opening of each hole is larger than the second opening.

11. The plate of claim 9, wherein the first opening of each hole is smaller than the second opening.

12. The plate of claim 11, wherein each hole is defined according to a hole side that extends between the first opening and the second opening, and wherein the hole side provides a transition from the first opening to the second opening such that a first portion of each hole includes a cross sectional area that is substantially similar to a cross sectional area of the first opening, and a second portion of each hole includes a cross sectional area that is substantially similar to a cross sectional area of the second opening.

13. The plate of claim 9, wherein each hole is defined according to a hole side that extends between the first opening and the second opening, and wherein the hole side provides a substantially smooth transition from the first opening to the second opening.

14. The plate of claim 9, wherein each hole is defined according to a hole side that extends between the first opening and the second opening, and wherein the hole side provides an irregular transition from the first opening to the second opening.

15. The plate of claim 9, wherein the plate is disposed at an angle relative to a path of the liquid flowing downward toward the top portion of the plate, and wherein the angle of the plate and an angle of the plurality of spaced holes therethrough determine a direction in which the smaller droplets are dispersed.

16. The liquid dispersing system of claim 1, wherein each of the plurality of spaced holes comprises a substantially circular-shaped hole.

17. The liquid dispersing system of claim 16, wherein each of the plurality of spaced holes is one-sixteenth of an inch in diameter.

18. The plate of claim 9, wherein each of the plurality of spaced holes comprises a substantially circular-shaped hole.

* * * * *